US005924923A

United States Patent [19]

Chiguchi et al.

[11] Patent Number: 5,924,923

[45] Date of Patent: Jul. 20, 1999

[54] AIR CONDITIONER INDOOR UNIT

[75] Inventors: Satoshi Chiguchi; Eriko Nakayama; Tomoko Suzuki; Takashi Ikeda; Ken Morinushi; Yasuo Imaki; Sakuo Sugawara; Tetsuya Iizuka, all of Tokyo, Japan

[73] Assignee: Mitsubishi Denki Kabushiki Kaisha, Tokyo, Japan

[21] Appl. No.: 08/903,409

[22] Filed: Jul. 30, 1997

[30] Foreign Application Priority Data

| | | | |
|---|---|---|---|
| Aug. 23, 1996 | [JP] | Japan | 8-222353 |
| Aug. 23, 1996 | [JP] | Japan | 8-222354 |
| Sep. 20, 1996 | [JP] | Japan | 8-249366 |

[51] Int. Cl.[6] ..... F24F 13/075

[52] U.S. Cl. ..... 454/256; 165/122; 165/124; 415/53.1

[58] Field of Search ..... 415/53.1, 208.1; 454/233, 256, 313, 315, 320, 906; 165/122, 124

[56] References Cited

U.S. PATENT DOCUMENTS

| | | | |
|---|---|---|---|
| 3,695,775 | 10/1972 | Zenkner | 415/53.1 |
| 4,807,444 | 2/1989 | Aoki et al. | 62/179 |
| 5,127,238 | 7/1992 | Ichikawa et al. | 415/53.1 X |
| 5,194,043 | 3/1993 | Takahashi et al. . | |
| 5,197,850 | 3/1993 | Shinobu et al. | 415/53.1 |
| 5,547,018 | 8/1996 | Takahashi et al. | 165/122 X |
| 5,573,059 | 11/1996 | Hamamoto et al. | 165/124 |

FOREIGN PATENT DOCUMENTS

| | | | |
|---|---|---|---|
| 0 466 431 | 1/1992 | European Pat. Off. . | |
| 0 657 701 | 6/1995 | European Pat. Off. . | |
| 34 18 160 | 11/1985 | Germany | 415/53.1 |
| 61-44118 | 3/1986 | Japan . | |
| 62-131139 | 6/1987 | Japan . | |
| 2-40424 | 2/1990 | Japan . | |
| 3-67844 | 7/1991 | Japan . | |
| 3-279745 | 12/1991 | Japan | 454/319 |
| 4-52450 | 2/1992 | Japan | 454/256 |
| 7-49288 | 11/1995 | Japan . | |
| 2 146 426 | 4/1985 | United Kingdom | 454/319 |

OTHER PUBLICATIONS

Patent Abstracts of Japan, vol. 95, No. 11, Dec. 26, 1995, JP 07 217987, Aug. 18, 1995.

*Primary Examiner*—Harold Joyce
*Attorney, Agent, or Firm*—Oblon, Spivak, McClelland, Maier & Neustadt, P.C.

[57] ABSTRACT

An air conditioner indoor unit comprising: a housing; an impeller arranged in the housing and forming a cross flow fan; a rear side plate arranged downstream the impeller and forming a rear side of a diffused air path; a front side plate forming a front side of the diffused air path and including a first air outlet surface, a second air outlet surface and a third air outlet surface; the first air outlet surface arranged near to the impeller and having a portion on a side of an air outlet of the diffused air path slanted in a direction away from a reference surface defined by the rear side plate; the second air outlet surface arranged next to the first air outlet surface on the side of the air outlet and having a portion on the side of the air outlet slanted in a direction away from the reference surface; and the third air outlet surface arranged next to the second air outlet surface on the side of the air outlet end and having a portion on the side of the air outlet slanted at 20°–30° in the direction away from the reference surface.

10 Claims, 13 Drawing Sheets

FIGURE 16

AIR CONDITIONER INDOOR UNIT

The present invention relates to an indoor unit for an air conditioner which has an essential part constituted by a cross flow fan.

In FIGS. 15 and 16, there is shown an indoor unit for an air conditioner which is similar to a conventional air conditioner indoor unit disclosed in e.g. JP-Y-749288. FIG. 15 is a vertical sectional view of the indoor unit, and FIG. 16 is a schematic view to show how air is diffused from the indoor unit of FIG. 15.

In these Figures, reference 1 designates a housing for the indoor unit prepared as a separate type air conditioner, which is installed in a room (not shown), and which has an essential part constituted by a cross flow fan. Reference numeral 2 designates an impeller of the cross flow fan. Reference numeral 3 designates a diffused air path which is arranged downstream the impeller 2, i.e. on an air outlet side of the impeller 2, and opens on the housing 1. The diffused air path is constituted by a rear side plate 4 forming a rear side and a front side plate 5 forming a front side, and is formed with an air outlet 6. Reference numeral 7 designates two vanes which are apart from each other in the air outlet 6 and are arranged in parallel therein in a longitudinal direction thereof, and which are pivoted on the air outlet 6 through horizontal shafts so as to be swingable within a range of an angle E as shown in FIG. 15. Reference numeral 8 designates a heat exchanger which is arranged upstream the impeller 2 in the housing 1.

The conventional air conditioner indoor unit is constructed as stated earlier, and the impeller 2 is driven by an electric motor (not shown) for rotation to give energy to air, supplying the air in a raised pressure. The air supplied in such a raise pressure is directed through the diffused air path 3, which is formed in a linearly tapered form with a constant expanding angle to gradually expand toward the air outlet 6, directs the supplied air to the air outlet 6, and blows the supplied air out off the air outlet 6 as shown by arrows P in FIG. 16. Such an arrangement allows the diffused air path 3 to realize the static pressure regain of the diffused air to some extent and to establish a diffusing function to some extent.

The vanes 7 can be driven by a driving device (not shown) to change their positions, controlling the issuing direction of the diffused air.

When indoor air passes through the heat exchanger 8, the indoor air is subjected to heat exchange to become cool air or warm air, and the cool air or the warm air is blown out off the air outlet 6 into the room to carry out an air conditioning function.

In the conventional air conditioner indoor unit, the diffusing function by the diffused air path 3 is insufficient, which requires that the expanding angle of the diffused air path 3 be great. However, if the expanding angle of the diffused air path 3 is excessively great, the diffused air becomes unstable to increase noise.

In addition, there are created problems in that the function of the diffused air path 3 wherein a dynamic pressure as a speed energy component of air sucked by the cross flow fan is regained to a static pressure is insufficient, and that the width direction of the air outlet 6, i.e. the extent the air outlet in the right and left directions in FIG. 16 is too narrow to obtain the optimum diffusing function.

Further, there is created a problem in that the deflection angle of the vanes 7 which are arranged in the air outlet 6 to direct the diffused air in a horizontal blowing direction or a downward blowing direction is enlarged to increase air outlet loss by the vanes 7 and decrease the volumetric quantity of the diffused air or increase noise.

It is an object of the present invention to eliminate these problems, and to provide an air conditioner indoor unit capable of regaining the dynamic pressure of suction air to a static pressure in an effective manner to obtain required diffusing performance and to minimize noise.

According to a first aspect of the present invention, there is provided an air conditioner indoor unit comprising a housing; an impeller arranged in the housing and forming a cross flow fan; a rear side plate arranged downstream the impeller and forming a rear side of a diffused air path; a front side plate forming a front side of the diffused air path and including a first air outlet surface, a second air outlet surface and a third air outlet surface; the first air outlet surface arranged near to the impeller and having a portion on a side of an air outlet of the diffused air path slanted in a direction away from a reference surface defined by the rear side plate; the second air outlet surface arranged next to the first air outlet surface on the side of the air outlet and having a portion on the side of the air outlet slanted in a direction away from the reference surface; and the third air outlet surface arranged next to the second air outlet surface on the side of the air outlet end and having a portion on the side of the air outlet slanted at 20°–30° in the direction away from the reference surface.

The reference surface means an outermost surface of the rear side plate on the side of the air outlet, which is indicated by 10 in FIG. 10, and which is parallel with the first air outlet surface.

According to a second aspect of the present invention, there is provided an air conditioner indoor unit, wherein the first air outlet surface has the portion on the side of the air outlet slanted at 0°–5° in a direction away from the reference surface, the second air outlet surface has the portion on the side of the air outlet slanted at 7°–15° in the direction away from the reference surface, and the first, second and third air outlet surfaces have each of connected portions therebetween formed with a curved surface so as to provide a successively changed slant.

According to a third aspect of the present invention, there is provided an air conditioner indoor unit, wherein a ratio of depth size of the first air outlet surface to height size of the diffused air path, a ratio of depth size of the second air outlet surface to the height size of the diffused air path and a ratio of depth size of the third air outlet surface to the height size of the diffused air path are respectively set to not less than 0.3.

According to a fourth aspect of the present invention, there is provided an air conditioner indoor unit, wherein there are provided an edge portion forming an air outlet edge of the rear side plate and a deflecting member arranged on the rear side plate near to the air outlet and located nearer to the impeller than the edge portion, depth size of the deflecting portion in the air outlet along an diffusing direction is not greater than 0.3 times the height size of the diffused air path, and the deflecting portion has an upper surface with a leading portion and a base portion, the leading edge arranged to be slanted at 10°–25° in a direction away from the reference surface in comparison with the base portion so as to direct an air flow along the rear side plate in the diffused air path to a direction along a vane provided in the air outlet.

According to a fifth aspect of the present invention, there is provided an air conditioner indoor unit, wherein a vane is arranged in the air outlet and is pivoted therein through a horizontal axis so as to make a position controllable, the vane is set at a first position to diffuse cool air generated by the cross flow fan in a horizontal or upward direction on start-up, the vane is displaced from the first position to a second position to diffuse the air more downwardly than the vane in the first position after elapse of a vapor condensation limit time for cool air supplied by the vane in the first position so as to eliminate vapor condensation on the vane, and the vane is returned to the first position after elimination of the vapor condensation, the vapor condensation limit time determined based on a diffused air temperature of the cool air, and a temperature and a humidity in a room with the indoor unit installed.

According to a sixth aspect of the present invention, there is provided an air conditioner indoor unit, wherein the vane in the second position has a lower diffusing speed of the cool air than the vane in the first position.

According to a seventh aspect of the present invention, there is provided an air conditioner indoor unit, wherein a vane is arranged in the air outlet and is pivoted therein through a horizontal shaft so as to make a position controllable, and a frame member for having a vane drive motor fixed thereto is provided with a receiving portion for supporting the shaft.

According to an eighth aspect of the present invention, there is provided an air conditioner indoor unit, wherein a vane is arranged in the air outlet and is pivoted therein through a horizontal shaft so as to make a position controllable, and a frame member for having a vane drive motor fixed thereto is provided with a hole for supporting the shaft.

According to a ninth aspect of the present invention, there is provided an air conditioner indoor unit, wherein the frame member is made of a material different from the shaft, and the frame member is integrally provided with a bearing portion having the hole for receiving the shaft in the eighth aspect.

According to a tenth aspect of the present invention, there is provided an air conditioner indoor unit, wherein the air outlet is made of an air outlet member, the air outlet member is formed with a through hole, the bearing portion is formed to project from the frame member, and the bearing portion is inserted in the through hole in the air outlet member in the ninth aspect.

In accordance with the first aspect of the present invention, the third air outlet surface has the portion on the side of the air outlet slanted at 25–30° in the direction away from the reference surface, allowing the diffused air path to regain a dynamic pressure of air sucked by the cross flow fan to a static pressure in a sufficient manner, and conditioned air to be diffused without coming off the front side plate. As a result, an effective diffusing function can be obtained to make the diffused air stable, obtaining quiet operation and a required diffusing function by the diffused air path.

In accordance with the second aspect of the present invention, the first air outlet surface, the second air outlet surface and the third air outlet surface have the respective portions on the side of the air outlet slanted in the direction away from the reference surface, allowing the diffused air path to regain the dynamic pressure of the suction air by the cross flow fan to a static pressure in a sufficient manner, and the diffused air to be blown off in a wide range without coming off the front side plate. As a result, an effective diffusing function can be obtained to make the diffused air stable, obtaining quiet operation and a required diffusing function by the diffused air path.

In addition, when a vane is arranged in the air outlet of the diffused air path to obtain a horizontal air flow or a downward air flow, it is possible to make the deflection angle of the vane small. As a result, the air outlet pressure loss of the horizontal air flow or the downward air flow by the vane can be minimized to prevent air volume from decreasing and noise from increasing. This offers advantages in that quiet operation is established and diffusing performance is improved.

In accordance with the third aspect of the present invention with the first aspect included, the third air outlet surface as the portion of the side of the air outlet slanted at 20°–30° in the direction away from the reference surface, allowing the diffused air path to regain the dynamic pressure of the suction air by the cross flow fan to a static pressure in a sufficient manner, and the diffused air to be blown off without coming off the front side plate. As a result, an effective diffusing function can be obtained to make the diffused air stable, obtaining quiet operation and a required diffusing function by the diffused air path.

In addition, the dynamic pressure of the suction air generated by the impeller of the cross flow fan can be regained to a static pressure in a sufficient manner by providing the diffused air path with such a structure that the ratio of the depth size of each of the air outlet surfaces to the height size of the diffused air path is set to not to less than 0.3. Such arrangement can offer such a diffusing function that air volume increases when the impeller rotates at the same speed and noise decreases when the same air volume is maintained.

In accordance with the fourth aspect of the present invention with the first aspect included, the third air outlet surface as the portion on the side of the air outlet slanted at 20°–30° in the direction away from the reference surface, allowing the diffused air path to regain the dynamic pressure of the suction air by the cross flow fan to a static pressure in a sufficient manner, and the conditioned air to be diffused without coming off the front side plate. As a result, an effective diffusing function can be obtained to make the diffused air stable, obtaining quiet operation and a required diffusing function by the diffused air path.

Since the deflecting portion is arranged on the rear side plate near to the air outlet to be slanted at 10–25° in the direction away from the reference surface, it is easy to obtain a required horizontal air flow or downward air flow even if a vane arranged in the air outlet is set at a small deflection angle. The air outlet pressure loss of the horizontal air flow or downward air flow by the vane can be minimized, offering an advantage in that diffusing performance can be obtained with an increased air volume in comparison with a case with the same air flow direction and the same noise.

The depth size of the deflecting portion in the air outlet in the diffusing direction is not greater than 0.3 times the height size of the diffused air path. As a result, it is easy to obtain a required horizontal air flow or downward air flow even if the vane is set at a small deflection angle.

It is possible to smoothly separate the air flow from the deflecting member in the diffused air path between the edge portion forming the air outlet edge of the rear side plate and the deflecting member arranged on the rear side plate near to the air outlet and located nearer to the impeller than the edge portion. Such arrangement can offer advantages in that vapor condensation is avoided and vapor condensation treatment can be made easily between the edge portion and the deflecting member.

Other advantages offered by other aspects of the present invention may be readily understood from explanation on embodiments stated later.

Figure 1:
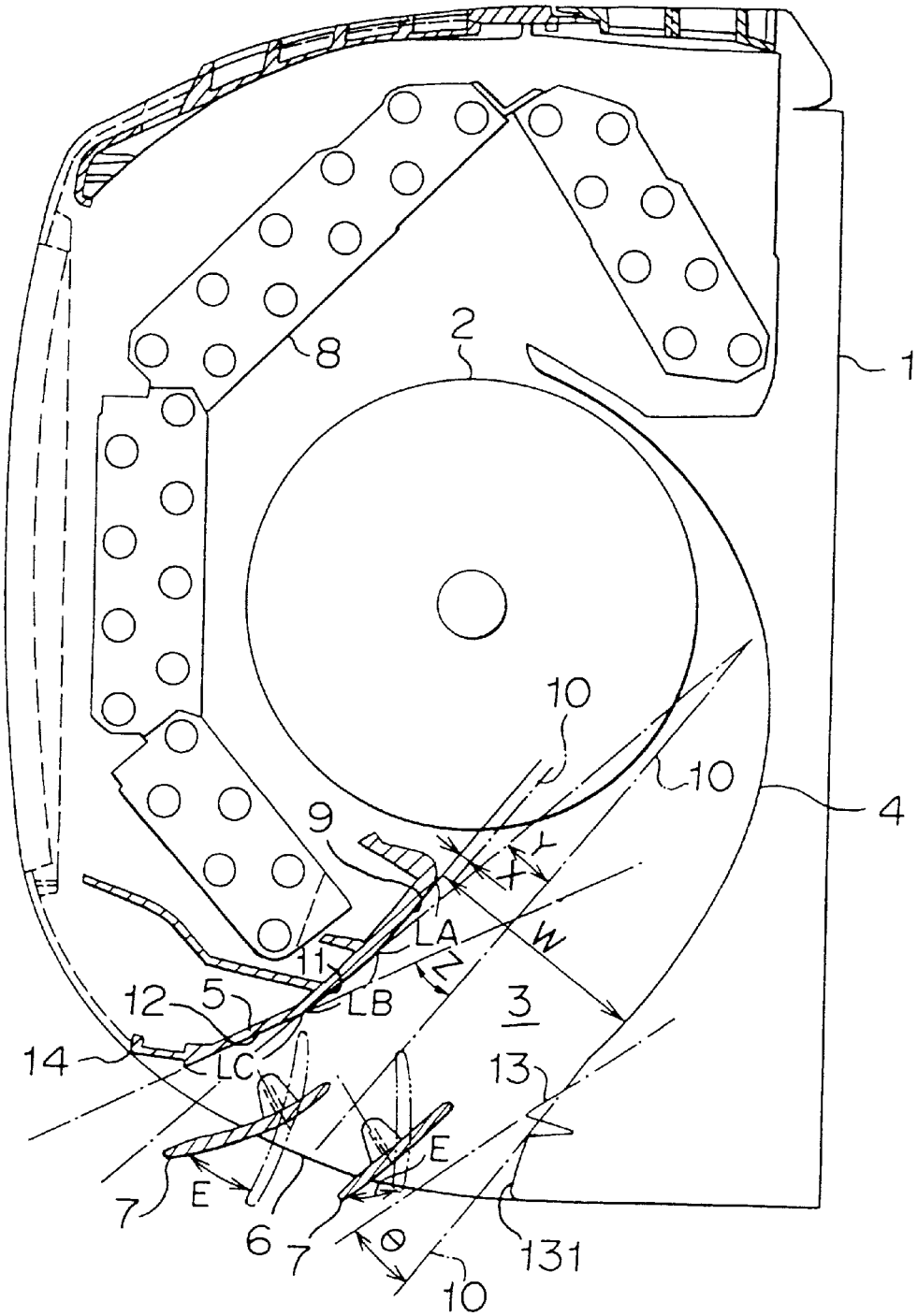
FIG. 1 is a vertical sectional view of the air conditioner indoor unit according to a first embodiment of the present invention.
Figure 3:
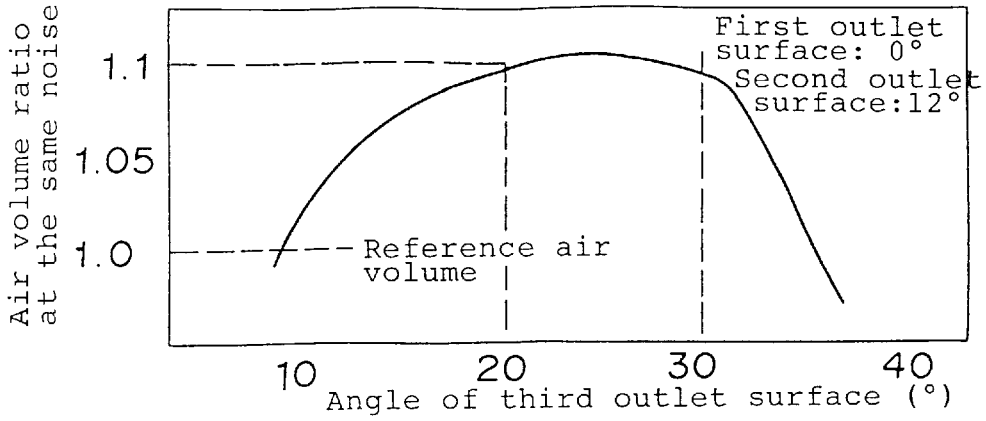
Figure 3:
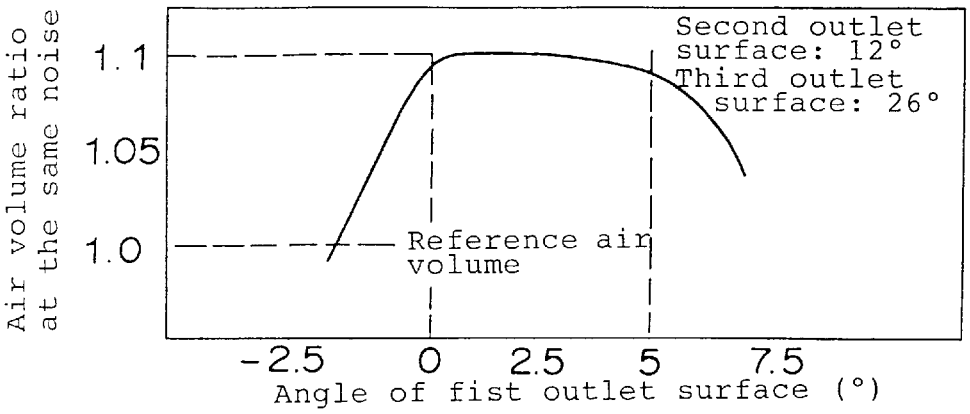
Figure 3:
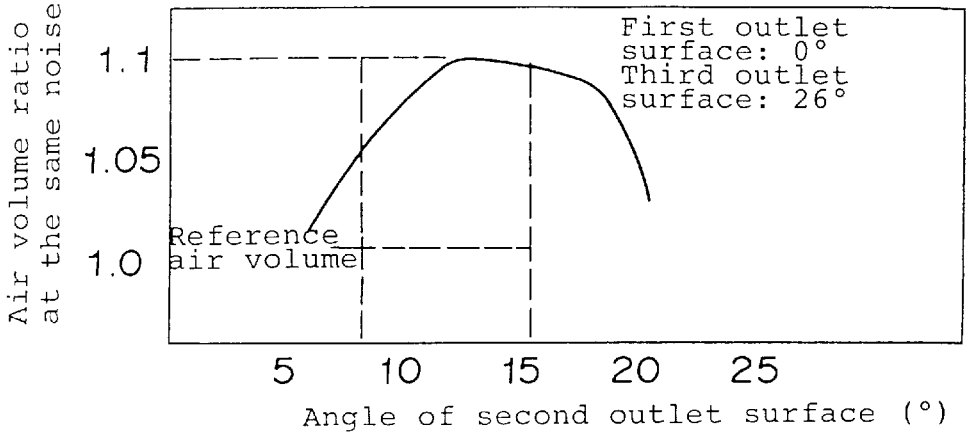
Figure 4:
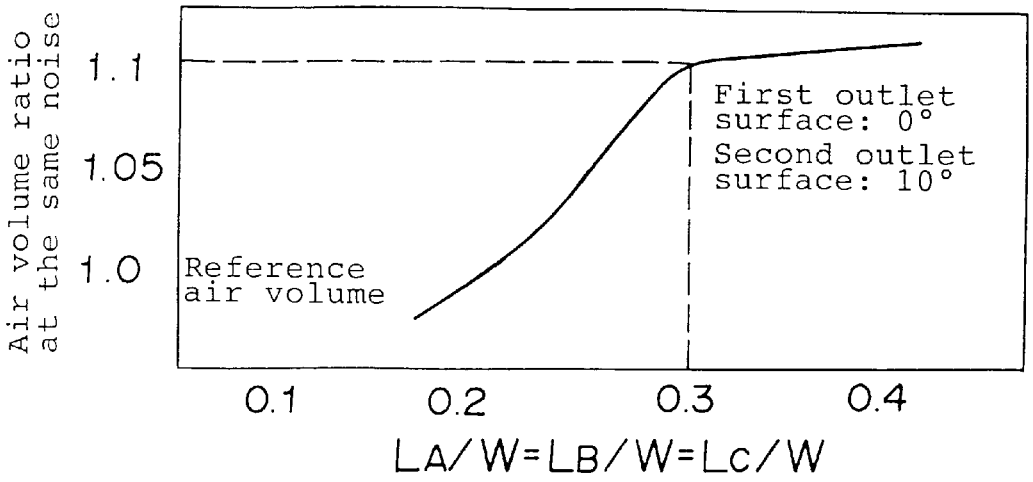
Figure 5:
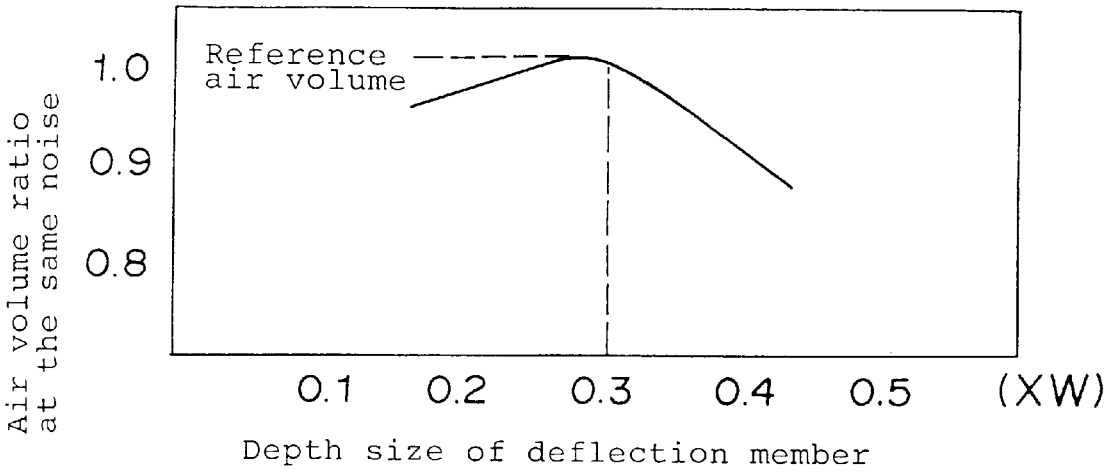
Figure 6:
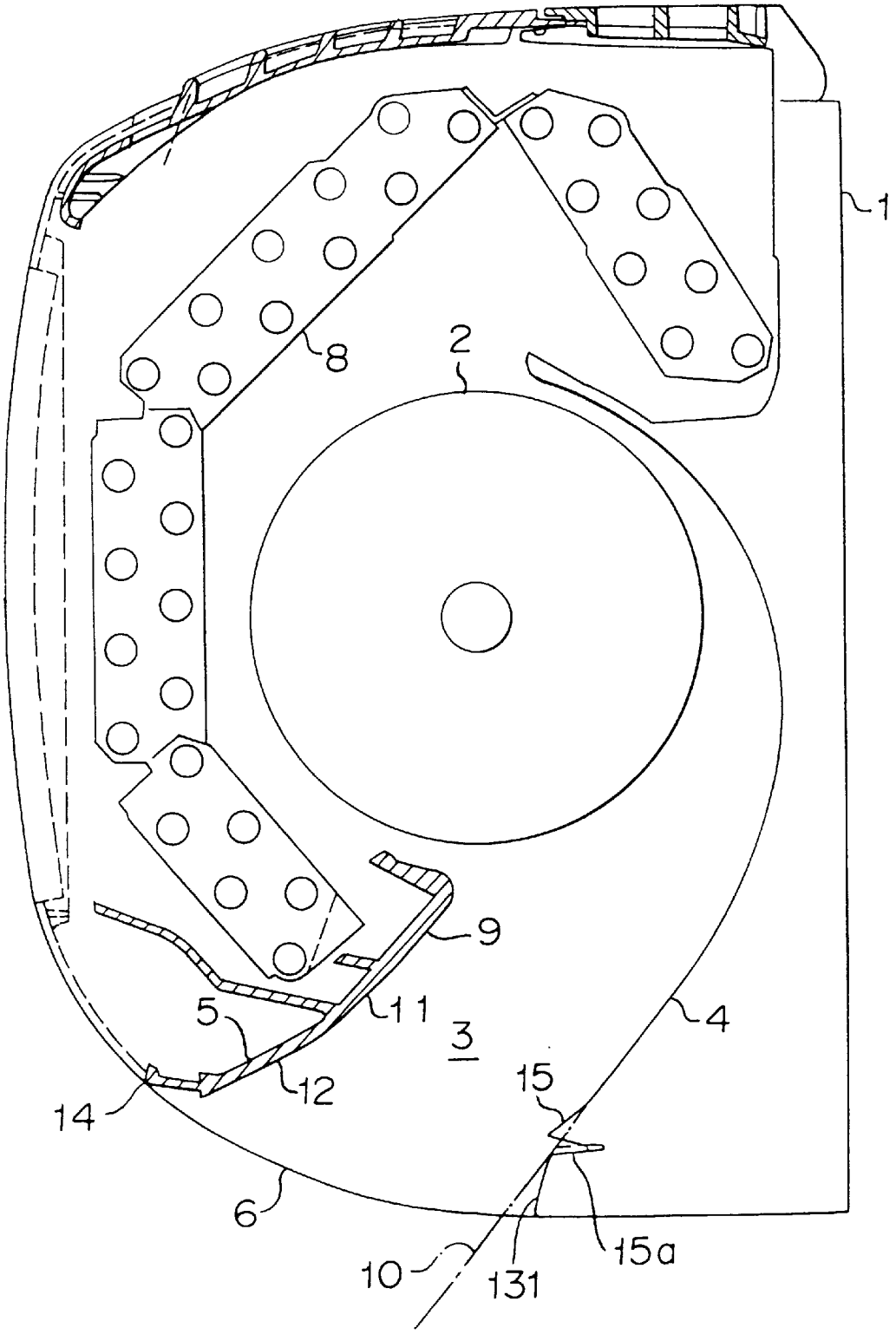
Figure 7:
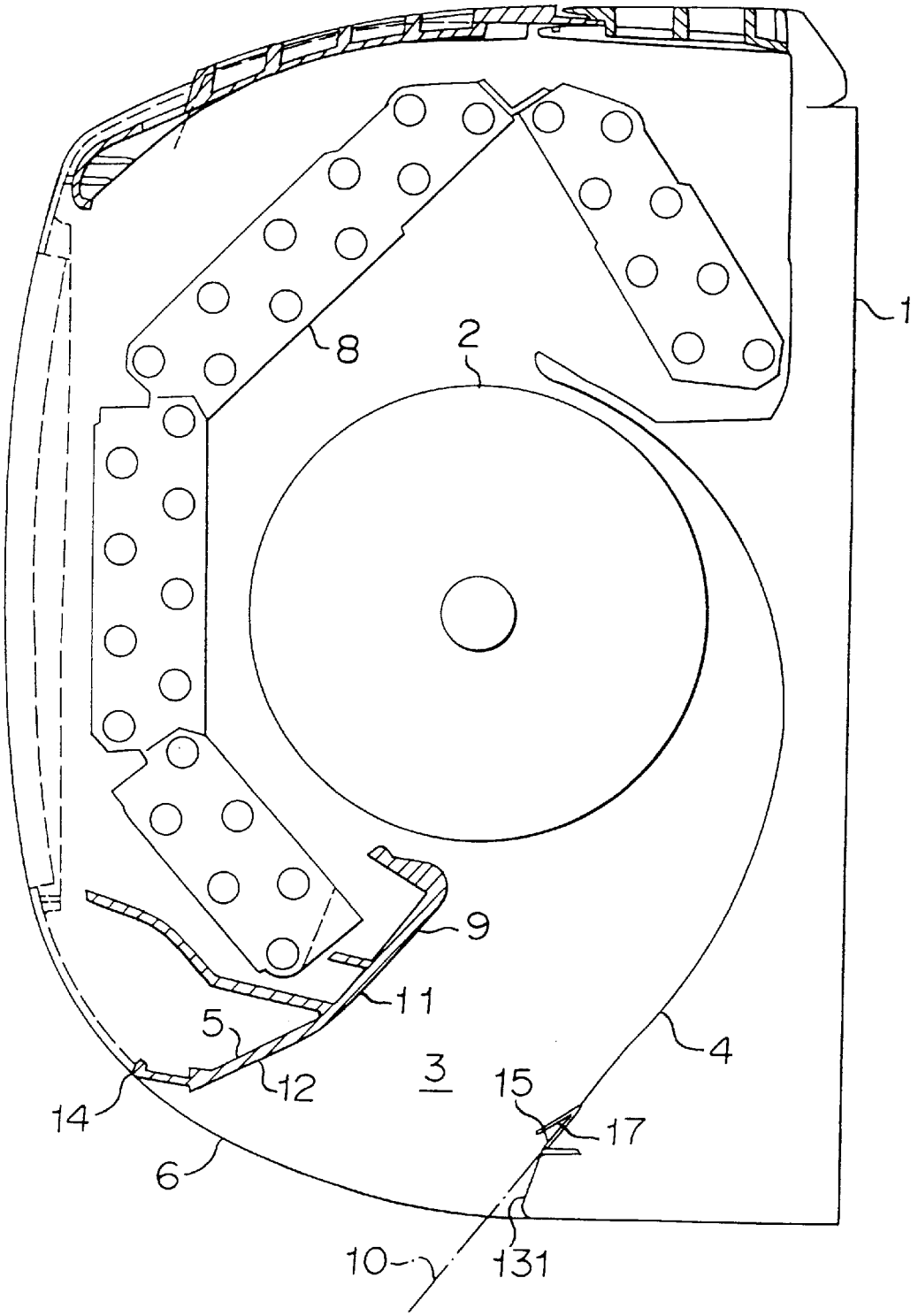
Figure 8:
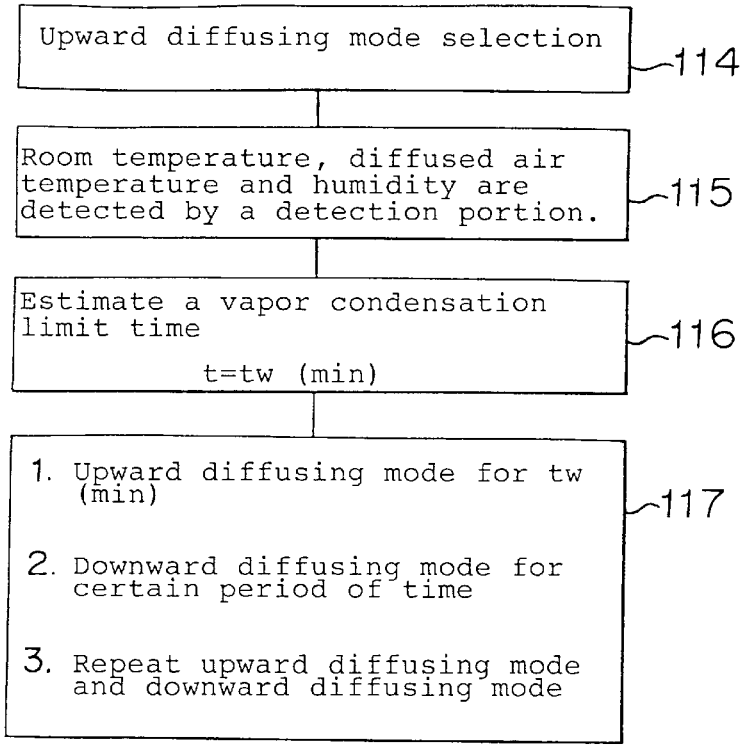
Figure 9:
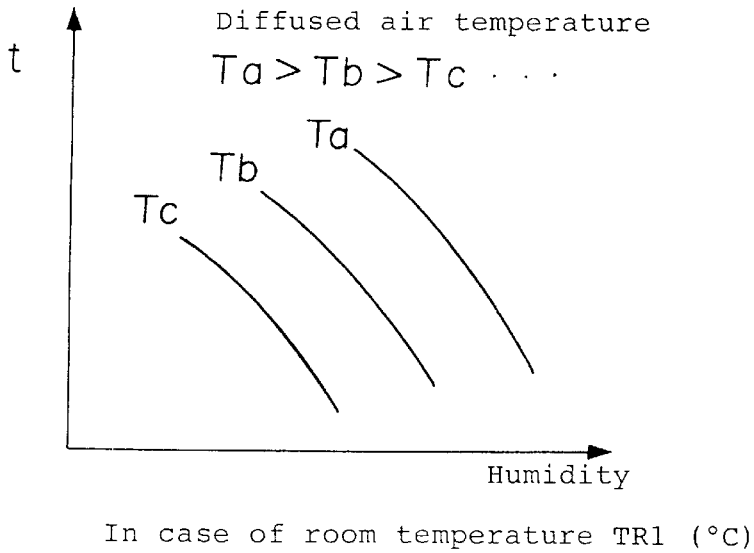
Figure 10:
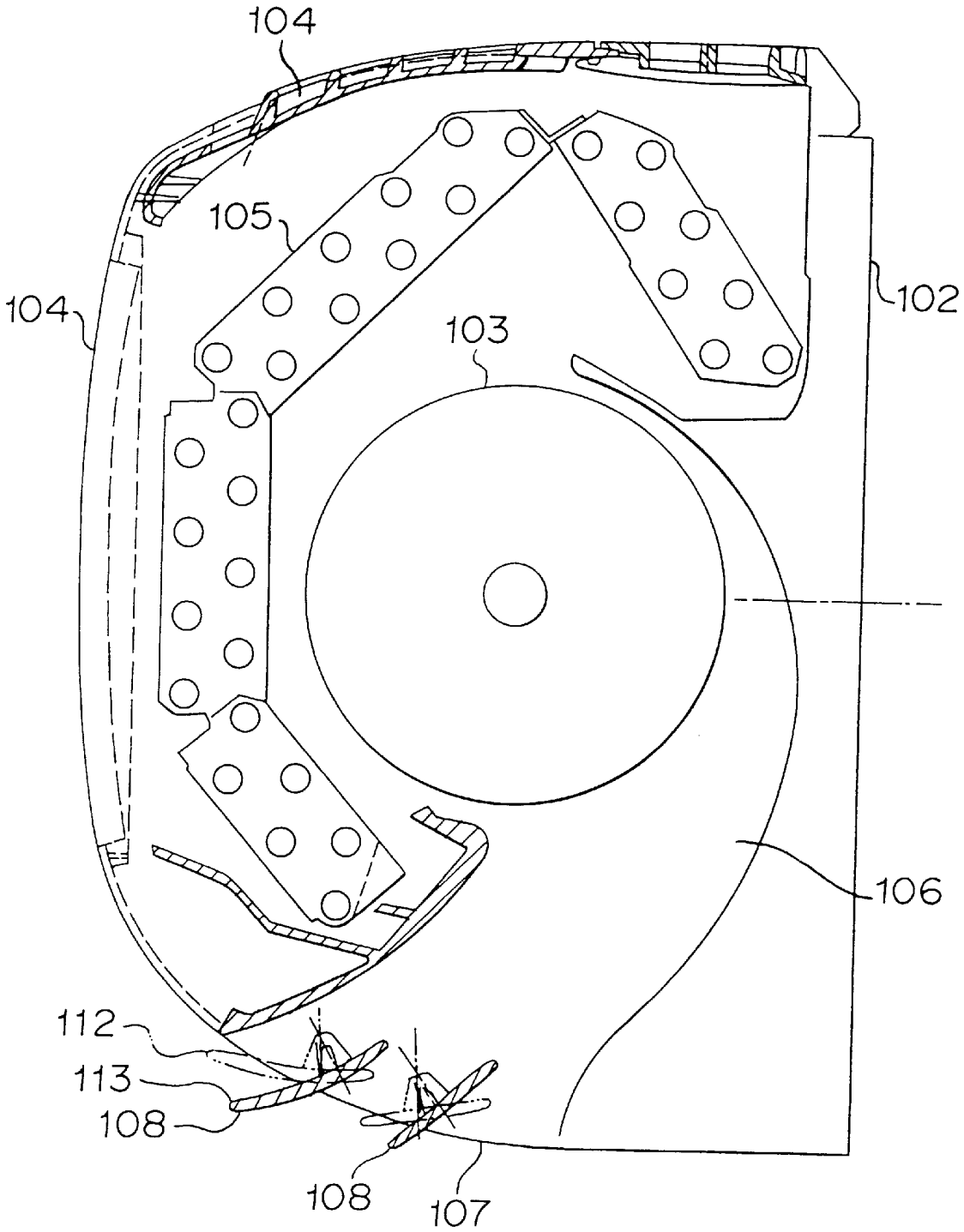
Figure 11:
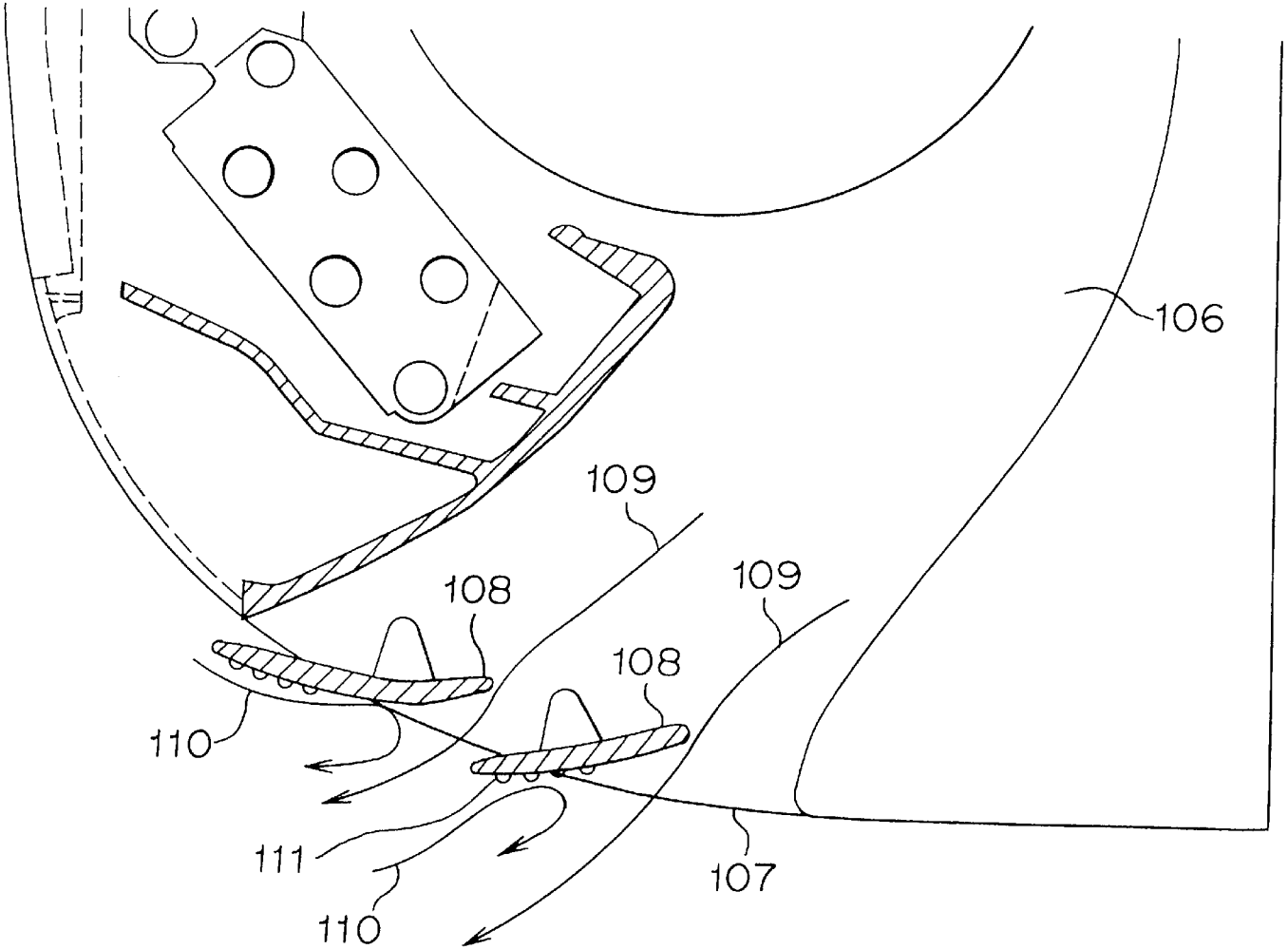
Figure 12:
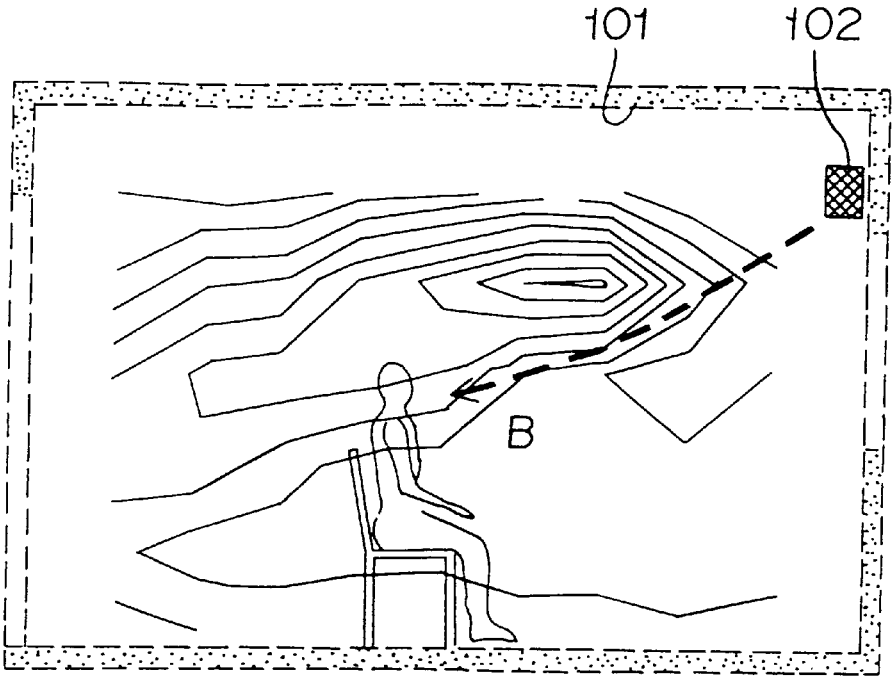
Figure 13:
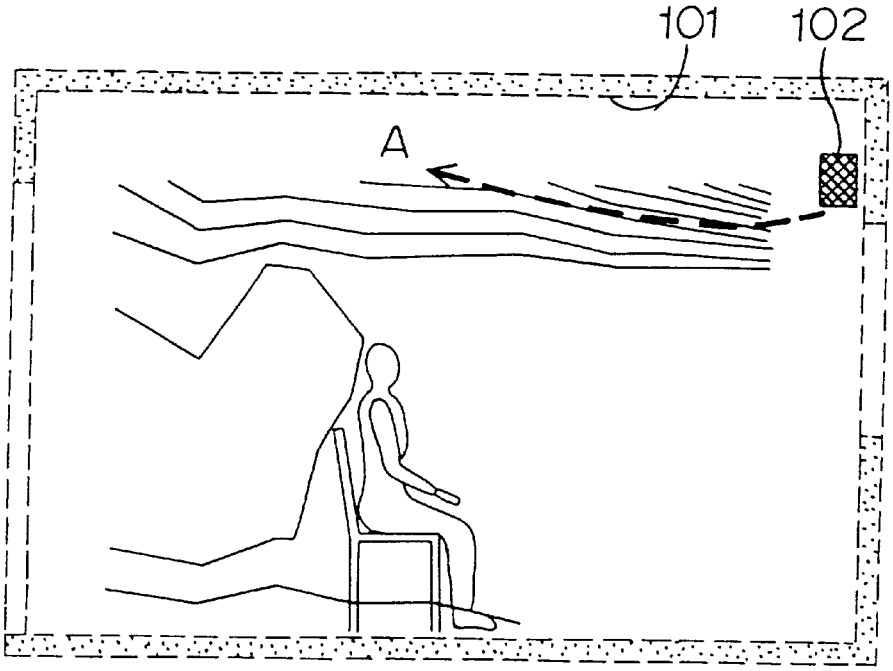
Figure 14:
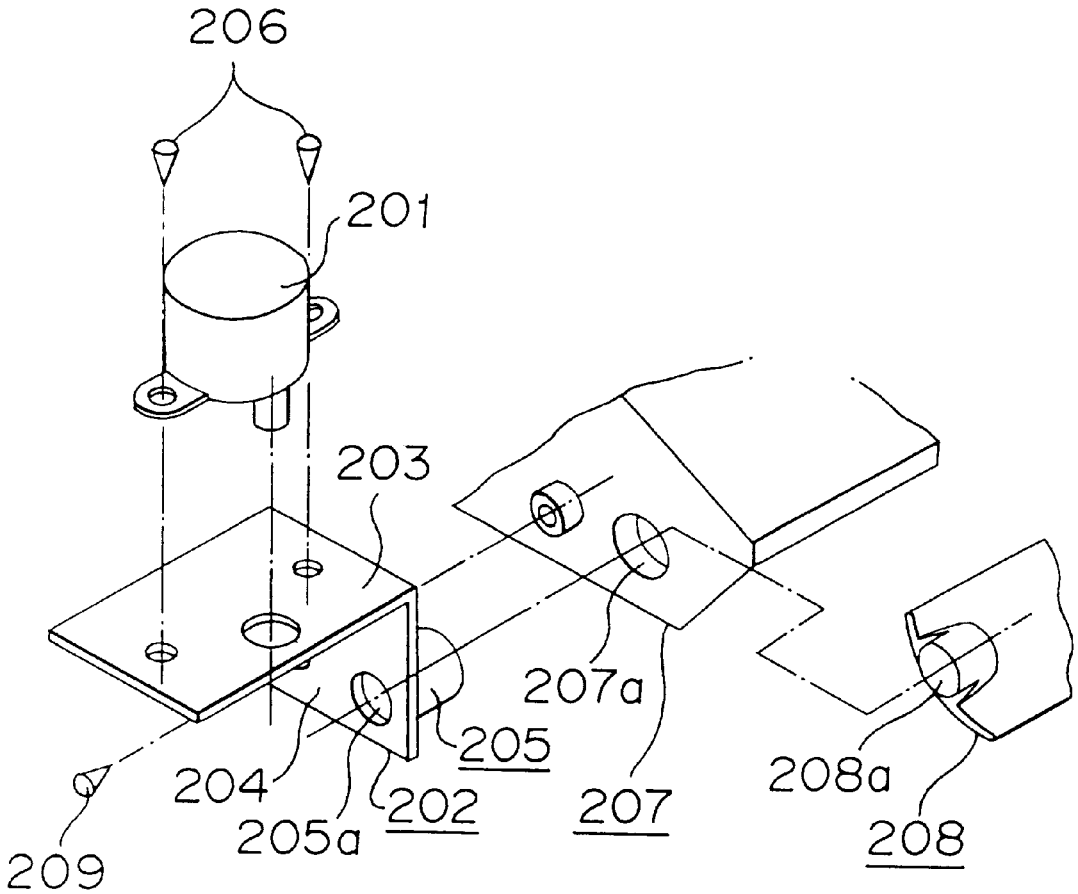
Figure 15:
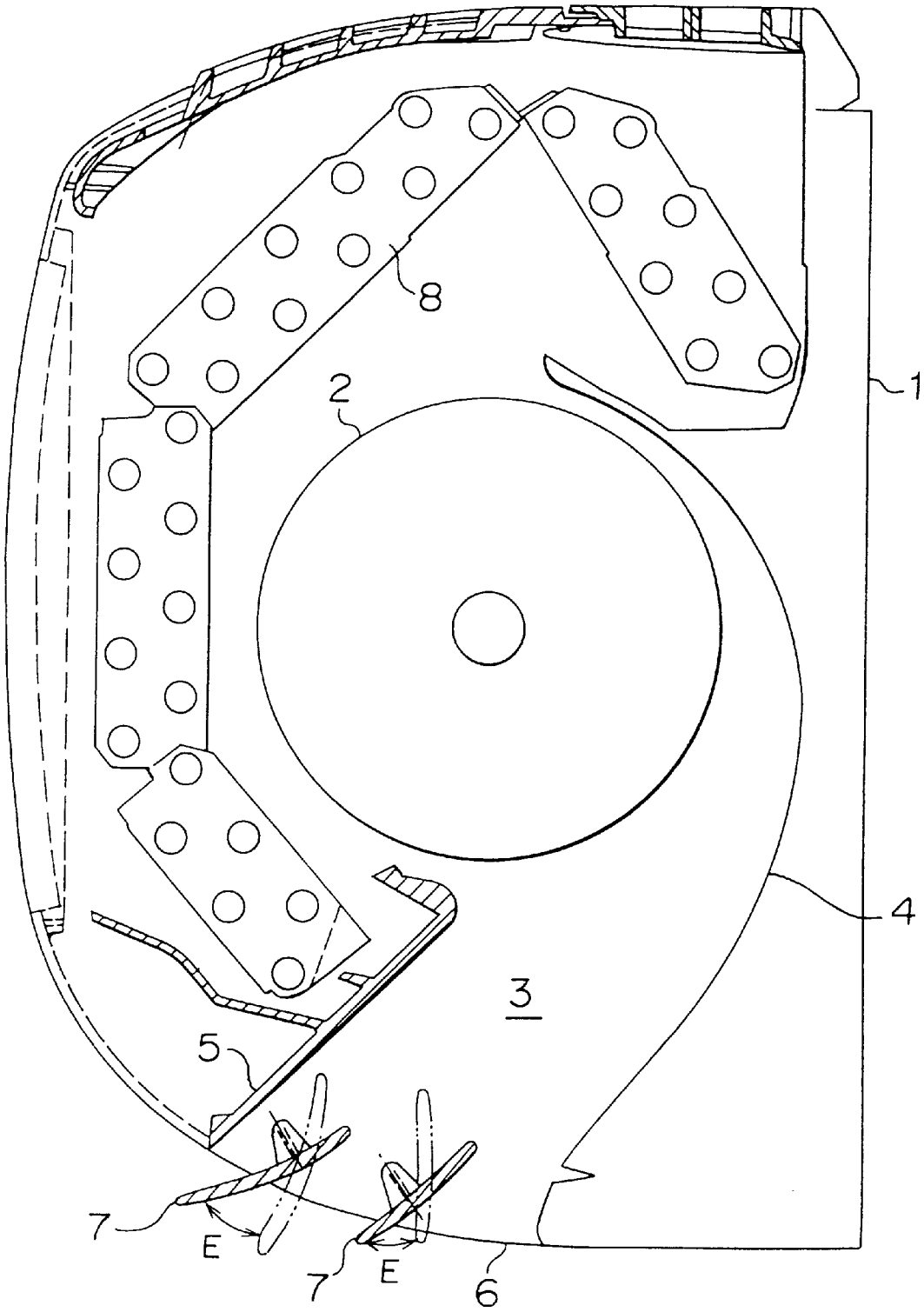
Figure 16:
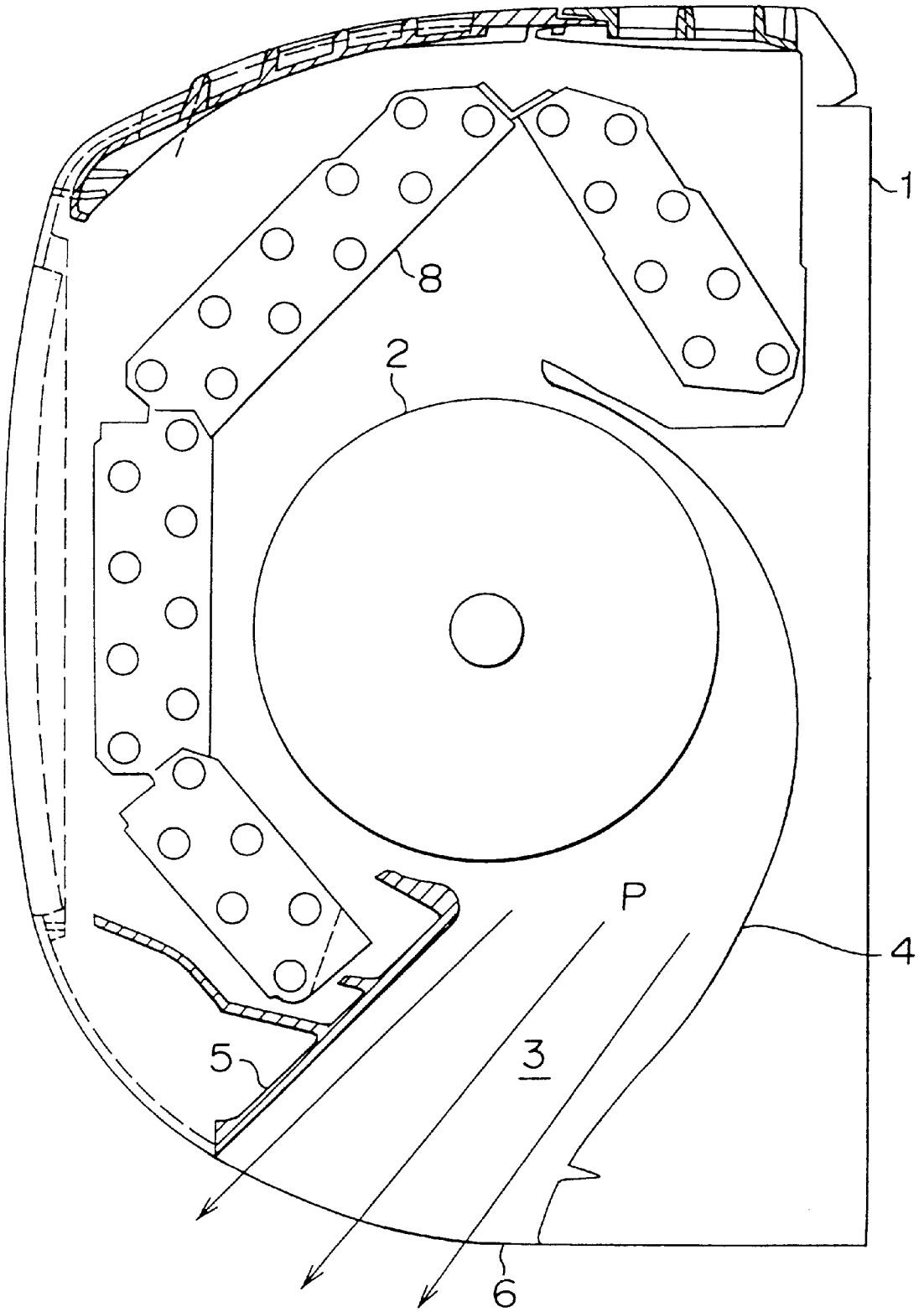

FIGS. 3(*a*)–(*c*) are graphs to show the characteristics of noise and air volume relevant to the structure of the diffused air path of FIG. 1;

FIG. 4 is a graph to show the characteristics of noise and air volume relevant to the depth size of air outlet surfaces of the diffused air path of FIG. 1;

FIG. 5 is a graph to show the characteristics of noise and air volume relevant to the depth size of a deflecting member in the diffused air path of FIG. 1;

FIG. 6 is a view similar to FIG. 1, showing a second embodiment of the present invention;

FIG. 7 is a view similar to FIG. 1, showing a third embodiment of the present invention;

FIG. 8 is a flow chart to show an air flow control manner in the indoor unit according to a fourth embodiment of the present invention;

FIG. 9 is a graph showing vapor condensation limit times in a horizontal air flow or upward air flow with respect to humidity at predetermined room temperatures and diffused air temperatures in the air flow control of FIG. 8;

FIG. 10 is a vertical sectional view of the indoor unit to explain how to control the air flow in the indoor unit;

FIG. 11 is an enlarged view of the essential portions of FIG. 10 to explain how the air is diffused from the indoor unit of FIG. 10;

FIG. 12 is a vertical sectional view showing a state of a room with the indoor unit installed of FIG. 10;

FIG. 13 is a vertical sectional view showing another state of the room;

FIG. 14 is an exploded perspective view showing a fifth embodiment of the present invention;

FIG. 15 is a vertical sectional view of a conventional air conditioner indoor unit; and FIG. 16 is a view similar to FIG. 15 showing how air is diffused from the indoor unit of FIG. 15.

Now, preferred embodiments of the present invention will be described in detail in reference to the accompanying drawings.

EMBODIMENT 1

Figure 2:
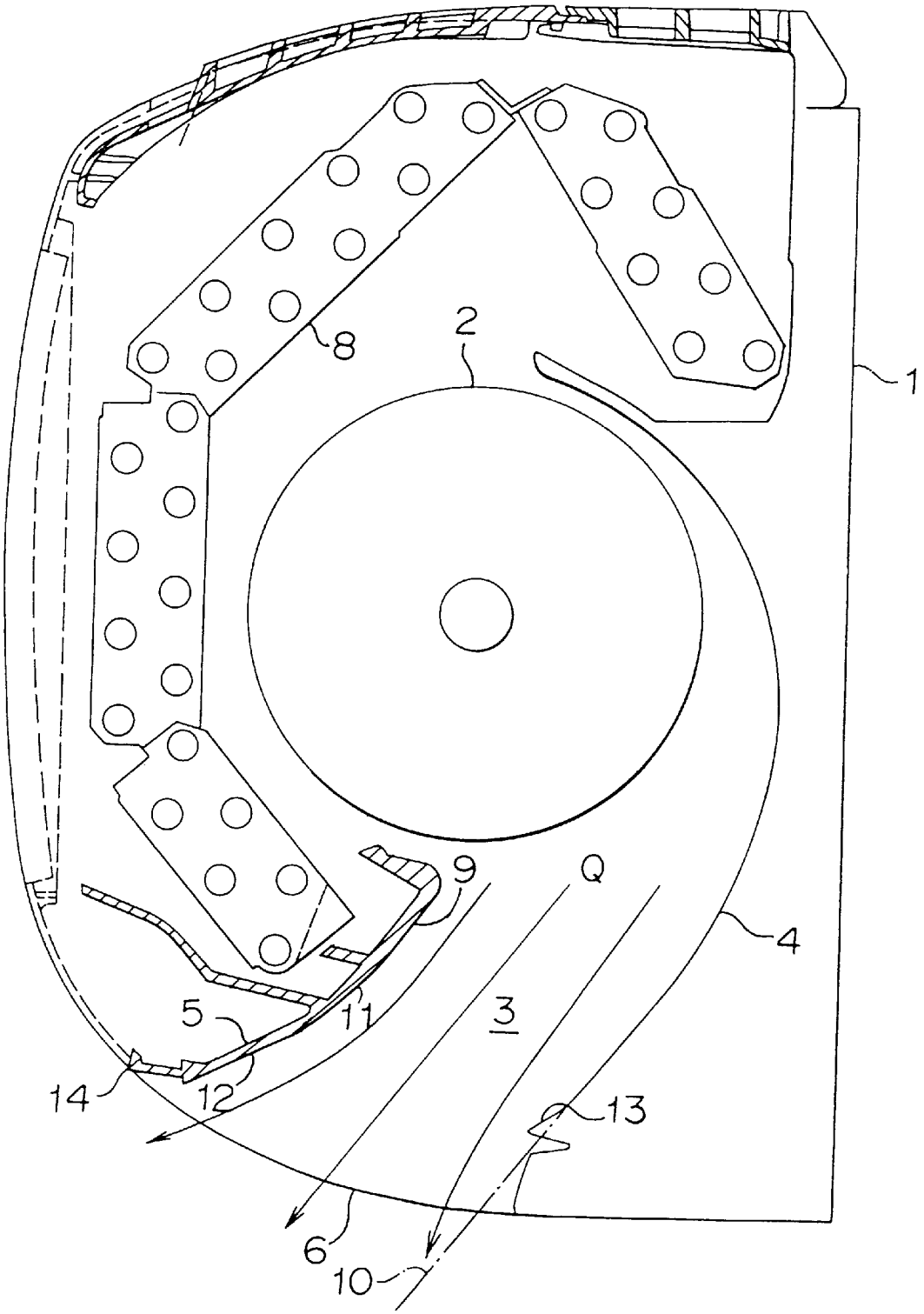
FIG. 2 is a schematic view to show how air is diffused from the indoor unit of FIG. 1.

In FIGS. 1–5, there is shown a first embodiment of the present invention. In FIG. 1, there is shown a vertical sectional view of the air conditioner indoor unit according to the first embodiment. In FIG. 2, it 25 is shown how conditioned air is diffused from the indoor unit of FIG. 1. In FIGS. 3(*a*)–(*c*), there are shown graphs showing the characteristics of noise and air volume relevant to the structure of a diffused air path stated later. In FIG. 4, there is shown a graph showing the characteristics of noise and air volume relevant to depth size of air outlet surfaces in the diffused air path stated later. In FIG. 5, there is shown a graph showing the characteristics of noise and air volume relevant to depth size of a deflecting member in the diffused air path stated later.

In these Figures, reference numeral 1 designates a housing for a separate type air conditioner which is installed in a room (not shown), and which has an essential part constituted by a cross flow fan. Reference numeral 2 designates an impeller of the cross flow fan. Reference numeral 3 designates a diffused air path which is arranged downstream the impeller 2, i.e. on an air outlet side, and opens on the housing 1, which is constituted by a rear side plate 4 forming a rear side and a front side plate 5 forming a front side, and which is constructed as stated later and is formed with an air outlet 6.

Reference numeral 7 designates a plurality of vanes (two vanes in FIG. 1) which are apart from each other in the air outlet 6 and are arranged in parallel in the air outlet 6 in a longitudinal direction thereof, which are pivoted to the air outlet 6 through horizontal axes, and which are arranged to be swingable within a range of an angle E. Reference numeral 8 designates an heat exchanger which is upstream the impeller 2 in the housing 1.

The front side plate 5 is constituted by a first air outlet surface, a second air outlet surface and a third air outlet surface which will be explained. Specifically, reference numeral 9 designates the first air outlet surface which is located near to the impeller 2, and which has a portion on a side of the air outlet of the diffused air path 3 arranged in a direction away from reference surface 10 defined by the rear side plate 4 so as to be slanted at 0°–5° with respect to the reference surface 10 in an angle X shown in FIG. 1.

Reference numeral 11 designates the second air outlet surface which is located next to the first air outlet surface 9 on the side of the air outlet, and which has a portion of the side of air outlet of the diffused air path 3 arranged in a direction away from the reference surface 10 so as to be slanted at 7°–15° with respect to the reference surface 10 in an angle Y shown in FIG. 1. Reference numeral 12 designates the third air outlet surface which is located next to the second air outlet surface 11 on the side of the air outlet, and which has a portion on the side of the air outlet of the diffused air path 3 arranged in a direction away from the reference surface 10 so as to be slanted at 20°–30° with respect to the reference surface 10 in an angle Z in FIG. 1.

The first air outlet surface 9, the second air outlet surface 11 and the third air outlet surface 12 have each of connected portions therebetween formed with a curved surface so as to provide a successively changed slant.

In FIG. 1, reference LA designates depth size of the first air outlet surface 9, reference LB designates depth size of the second air outlet surface 11, reference LC designates depth size of the third air outlet surface 12, and reference W designates height size of the diffused air path.

Reference numeral 13 designates a deflecting member which is located on the rear side plate 4 near to the air outlet 6 and is arranged in parallel with the air outlet 6 in the longitudinal direction thereof, which has a leading portion arranged in a direction away from the reference surface 10 in comparison with a base portion thereof, and which has an upper surface placed so as to be slanted at 10°–25° with respect to the reference surface 10 in an angle θ shown in FIG. 1. The length of the deflecting member 13 in a diffusing direction at the air outlet 6, i.e. the depth size of the deflecting member is set to not greater than 0.3 times the height size of the diffused air path.

Reference numeral 131 designates an edge portion which is provided on the rear side plate 4 nearer to the air outlet 6 than the deflecting member 13, and which forms the edge of the air outlet 6.

Reference numeral 14 designates a front vane which is placed next to the third air outlet surface 12 on the side of the air outlet 6, and which is arranged in parallel with the air outlet 6 in the longitudinal direction thereof.

In the air outlet arrangement of the air conditioning indoor unit constructed as stated above, the impeller 2 is driven by an electric motor (not shown) for rotation to give energy to air, supplying the air in a raised pressure. The diffused air path 3 is constituted as follows. Specifically, the diffused air path is provided with a structure shown in FIG. 2 by the first air outlet surface 9, the second air outlet surface 11 and the third air outlet surface 12, i.e. is formed so that the diffused air path is constituted by the rear side plate 4 and the front side plate 5 curved in a convex shape with an intermediate portion in the depth direction projected in a vertical section, and that the front side is thus curved to provide a divergent shape to the diffusing air path on the side of the air outlet 6.

A flow of of the air supplied in such a raised pressure is directed through the diffused air path 3, and is blown out off the air outlet 6 as shown by arrows Q in FIG. 2. The diffused air path 3 allows the diffused air to regain a static pressure and a diffusing function to be created. The direction of the diffused air can be controlled by using a driving device (not shown) to drive the vanes 7 so as to change the positions of the respective vanes.

When indoor air is passing through the heat exchanger 8, the air is subjected to heat exchange to become cool air or warm air, and the cool air or the warm air is blown out off the air outlet 6 into the room, carrying out air conditioning.

In the embodiment shown in FIGS. 1–5, the third air outlet surface 12 is arranged to be slanted at 20°–30° with respect to the reference surface 10 in the angle Z shown in FIG. 1. This allows the diffusing air path 3 to regain the dynamic pressure of air sucked by the cross flow fan to a static pressure in an effective manner. In addition, the diffused air can be blown out off without coming off the front side plate 5. As a result, an effective diffusing function can be obtained to make the diffused air stable, reducing noise and obtaining a diffusing function required for the diffused air by the diffused air path 3.

In the embodiment shown in FIGS. 1–5, the first air outlet surface 9 is arranged to be slanted at 0°–5° with respect to the reference surface 10 in the angle X shown in FIG. 1. The second air outlet surface 11 is arranged to be slanted 7°–15° with respect to the reference surface 10 in the angle Y shown in FIG. 1. The third air outlet surface 12 is arranged to be slanted at 20°–30° with respect to the reference surface 10 in the angle Z shown in FIG. 1. This arrangement allows the diffused air path 3 to blow out the diffused air in a wide range as shown by the arrows Q in FIG. 2 according to the characteristics shown in FIGS. 3(*a*)–(*c*).

By this arrangement, the deflection angle of the vanes 7 which are arranged in the air outlet 6 to obtain a horizontal air flow or downward air flow can be made small. As a result, diffusing pressure loss of the horizontal air flow or downward air flow by the vanes 7 can be minimized to prevent the air volume from decreasing or noise from increasing, offering advantages in that quiet operation can be established and required diffusing performance can be obtained easily.

In the embodiment shown in FIGS. 1–5, the depth size LA of the first air outlet surface 9, the depth size LB of the second air outlet surface 11 and the depth size LC of the third air outlet surface 12 to the height size W of the diffused air path 3 shown in FIG. 1 are set to satisfy the requirement of LA/W, LB/W, LC/W≧0.3. It is possible to regain the dynamic pressure of the suction air caused by the impeller 2 of the cross flow fan to a static pressure in a sufficient manner by providing the diffused air path 3 with a shape satisfying the requirement.

By this arrangement, it is possible to obtain such diffusing performance that the air volume increases when the impeller 2 rotates at the same speed, and noise reduces at the same air volume as seen from the characteristics shown in FIG. 4.

In the embodiment shown in FIGS. 1–5, the deflecting member 13 is arranged on the rear side plate 4 near to the air outlet 6, and the deflection member has the upper surface arranged to be slanted at 10°–25° with respect to the reference surface 10 in the angle θ shown in FIG. 1. The length of the deflecting member 13 along the diffusing direction in the air outlet 6, i.e. the depth size of the deflecting member is set to not greater than 0.3 times the height size of the diffused air path 3. Such arrangement can obtain a required horizontal air flow or downward air flow easily even if the vanes 7 are set at a small deflection angle. Thus, the deflection angle of the vanes 7 can be minimized with keeping the horizontal air flow or downward air flow at the same direction. As a result, the diffusing pressure loss of the horizontal air flow or downward air flow by the vanes 7 can be minimized, obtaining such diffusing performance that the air volume increases in comparison with a case with the same air flow and the same noise as seen from the characteristics shown in FIG. 5.

EMBODIMENT 2

In FIG. 6, there is shown a view of a second embodiment of the present invention, which is similar to FIG. 1. The air conditioner indoor unit according to the second embodiment is constituted in the same manner as the embodiment shown in FIGS. 1–5 except for features shown in FIG. 6. In FIG. 6, identical or corresponding parts are indicated by the same reference numeral as those in FIGS. 1–5.

Reference numeral 15 designates a deflecting member which is located on the rear side plate 4 near to the air outlet 6, and which is arranged in parallel with the air outlet 6 in the longitudinal direction thereof. The deflecting member has a leading portion arranged in a direction away from the reference surface 10 in comparison with a base portion thereof. The deflecting member has an upper surface arranged to be slanted at a suitable angle with respect to the reference surface 10 as shown in FIG. 6. The deflecting member has a dented recess formed near to the air outlet 6. The length of the deflection member 15 along the diffusing direction in the air outlet 6, i.e. the depth size of the deflecting member is set to not greater than 0.3 times the height size of the diffused air path 3.

In the air outlet arrangement of the air conditioner indoor unit constructed as stated above, the impeller 2 is driven by the electric motor, and the diffused air path 3 is constituted by the rear side plate 4 and the front side plate 5 which is constituted by the first air outlet surface 9, the second air outlet surface 11 and the third air outlet surface 12. The deflecting member 15 and the leading vane 14 are also provided.

Although detailed explanation will be omitted, the embodiment of FIG. 6 can offer advantages similar to the embodiment of FIGS. 1–5.

When the deflecting member 15 is made of a heat insulating material, the deflecting member can have improved resistance to vapor condensation when cooled air is passing through the diffused air path 3.

In the second embodiment, there are provided the edge portion 131 on the rear side plate 4 which forms the edge of the air outlet 6, and the deflecting member 15 which is placed on the rear side plate 4 near to the air outlet 6 and is arranged nearer to the impeller 2 than the edge portion 131. Both members can provide the vented recess therebetween with good separation of the air flow with respect to the deflecting member 15 in the diffused air path 3 to avoid vapor condensation and can to carry out vapor condensation treatment more easily.

EMBODIMENT 3

In FIG. 7, there is shown a view of a third embodiment of the present invention, which is similar to FIG. 1. The air conditioner indoor unit according to the third embodiment is constituted in the same manner as the embodiment of FIGS. 1–5 except for the features shown in FIG. 7. In FIG. 7, identical or corresponding parts are indicated by the same reference numerals as those of FIGS. 1–5 and FIG. 6. Reference numeral 17 designates a sheet with fluff which is attached to a rear side of the deflecting member 15 in a plate shape.

In the air conditioner indoor unit constructed as stated above, the impeller 2 is driven by the electric motor, and the diffused air path 3 is constituted by the rear side plate 4 and the front side plate which is constituted by the first air outlet surface 9, the second air outlet surface 11 and the third air outlet surface 12. The deflecting member 15 and the leading vane 14 are also provided. Although detailed expression will be omitted, the embodiment of FIG. 7 can offer functions similar to the embodiments of FIGS. 1–5 and FIG. 6.

In the embodiment of FIG. 7, it is possible to retrieve vapor condensation which is created when the cooled air is passing through the diffused air path 3 because the deflecting member 15 in the plate shape has the rear side formed with the fluffy sheet 17.

Now, an embodiment of the present invention which is suited to air flow control for a vane arranged in the air outlets as stated earlier will be explained.

EMBODIMENT 4

In FIGS. 8 and 9, there is shown views of a fourth embodiment of the present invention. In FIG. 8, there is shown a flow chart to show an air flow control manner for the air conditioner indoor unit. In FIG. 9, there is shown a graph showing vapor condensation limit times in a horizontal air flow or upward air flow with respect to humidity at predetermined room temperatures and diffused air temperatures in the air flow control manner of FIG. 9.

In FIGS. 10–13, there are views to explain the air conditioner indoor unit. In FIG. 10, there is shown a vertical sectional view of the indoor unit to explain how to control the air flow in the indoor unit. In FIG. 11, there is shown an enlarged view of the essential parts of FIG. 10 to explain how conditioned air is diffused from the indoor unit of FIG. 10. In FIG. 12, there is shown a vertical sectional view to explain a state of a room with the indoor unit of FIG. 10 installed. In FIG. 13, there is shown a vertical sectional view to show another state of the room with the indoor unit of FIG. 10 installed.

In FIGS. 12 and 13, reference numeral 101 designates the room where the indoor unit 102 is installed. In FIG. 10, reference numeral 103 designates an impeller which forms a cross flow fan arranged in the indoor unit 102. Reference numeral 104 designates air inlets which are arranged upstream the impeller 103. Reference numeral 105 designates a heat exchanger which is arranged between the air inlets 104 and the impeller 103. Reference numeral 106 designates a diffused air path which is arranged downstream the impeller 103. Reference numeral 107 designates an air outlet which communicates with the diffused air path 106 and opens on the indoor unit 102.

Reference numeral 108 designates a plurality of vanes (two vanes in FIGS. 10 and 11) which are apart from each other in the air outlet 107 and are arranged in parallel in the air outlet 107 in the longitudinal direction thereof, and which are pivoted to the air outlet 107 through horizontal axes. The vanes are arranged to be swingable around respective pivoted axes as shown in FIG. 10. Reference numeral 109 designates cooled air which is supplied by the cross flow fan. Reference numeral 110 designates air flows in the room 101.

Reference numeral 111 designates vapor condensation which is deposited on lower surfaces of the vanes 8.

The polygonal lines shown in FIGS. 12 and 13 designate isothermal lines in the room 101. In FIG. 12, the intermediate portion of the room 101 in the height direction is at a low temperature. In FIG. 13, air having a low temperature is flowing at a high position in the room 101.

By the structure and the arrangement of the indoor unit 102 stated above, the air conditioner carries out cooling operation or dehumidifying operation as follows. The impeller 103 is driven by an electric motor (not shown) for rotation to diffuse cool air from the air outlet 107 through the diffused air path 106. The vanes 108 are swung by a driving device (not shown) to change the diffusing direction of the cool air.

Specifically, when the vanes 108 take a first position 112 indicated by broken lines in FIG. 10, the cool air is supplied in a horizontal direction or upward direction as indicated by an arrow A in FIG. 13.

When the vanes 108 take a second position 113 indicated by solid lines in FIG. 10, i.e. when the vanes take a more downward position than the first position 112, the cool air is supplied in a more downward direction than the horizontal direction as indicated by an arrow B in FIG. 12.

Referring to FIG. 8, an upward diffusing mode selection is made at Step 114 to set the vanes 108 to the first position 112, diffusing the cool air 109 supplied by the cross flow fan in the horizontal or upward direction. At Step 115, a detection portion (not shown) which is provided in the room 101 detects the room temperature TR1 (°C.) in the room 101, the diffused air temperature T (Ta>Tb>Tc) of the cool air 109 supplied by the cross flow fan, and the humidity in the room. At Step 116, a vapor condensation limit time t is set to t=tw (min.) by a controller (not shown) of the air conditioner indoor unit.

At Step 117, the controller of the indoor unit carries out such a control operation to command the upward diffusing mode wherein the vanes 108 take the first position 112 to diffuse the cool air 109 supplied by the cross flow fan in the horizontal or upward direction for tw (min.) based on the room temperature TR1 (° C.) in the room 101. When tw (min.) pass, the controller commands the downward mode with a short period of time wherein the vanes 108 take the second position 113 to diffuse the cool air 109 supplied by the cross flow fan in a direction which is more downward than the upward diffusing mode. As a result, the vapor condensation 111 deposited on the lower surfaces of the vanes 108 is eliminated. After that, the controller issues a command to repeat the upward diffusing mode and the downward diffusing mode.

By such an arrangement, the humidity for a predetermined room temperature and a vapor condensation limit time for a diffused air temperature of the cool air 109 in the upward diffusing mode by the cross flow fan are set at a microcomputer of the controller so as to correspond to the room temperature TR1 (° C.) in the room 101 according to the relation shown in FIG. 9. With the upward blowing mode selection 114 being made, the detection portion 115 detects factors such as the room temperature TR1 (° C.), and the vapor condensation limit time tw (min.) is set by the setting operation 116 based in the results of the detection.

The controller of the indoor unit issues the control operation 117 to carry out the upward blowing mode wherein the vanes 108 take the first position 112 to diffuse the cool air in the horizontal or upward direction for tw (min.). When tw (min.) pass, the vanes 108 take the second position 113, and the downward blowing mode is carried out to diffuse the cool air 109 for a short period of time in the downward direction which is more downward than the upper blowing mode. After that, diffusing air by the upward blowing mode and diffusing air by the downward blowing mode are repeated.

When the cooling operation or the dehumidifying operation is carried out in the room 101, the upward blowing mode is normally carried out to set the vanes 108 to the first position 112 so as to diffuse the cool air 109 in the horizontal or upward direction. Such arrangement can solve a problem in that the cool air hits directly on a person in the room 101 to make him or her feel chilly or uncomfortable.

When the vapor condensation limit corresponding to the room temperature TR1 (° C.) reaches with respect to the vapor condensation deposited on the vanes 108 by the upward blowing mode, i.e. when the vapor condensation limit time tw (min.) for the upward blowing mode pass, the vanes 108 take the second position 113 to carry out the downward blowing mode for a short period of time to diffuse the cool air 106 in the downward direction which is more downward than the upward blowing mode. By the downward blowing mode, the vapor condensation 111 deposited on the lower surfaces of the vanes 108 is eliminated. In that manner, the time to hit the cool air directly on a person in the room can be minimized, obtaining a comfortable air conditioning function or a comfortable dehumidifying function which is free from problems due to an increase in the vapor condensation 111.

EMBODIMENT 5

When the vanes 108 take the second position 113 in the embodiment of FIGS. 8 and 9, the cool air has a lower diffusing speed than the cool air which is diffused when the vanes 108 take the first position 112.

By such control, the cool air which is diffused when the vanes 108 take the second position 113 can have a low diffusing speed to weaken the cool air hitting on a person in the room, improving comfort during the cooling operation or the dehumidifying operation.

Next, an embodiment of a vane drive motor mounting device which is suited to a vane as stated earlier will be explained.

EMBODIMENT 6

In FIG. 14, there is shown an exploded perspective view of a sixth embodiment corresponding to the seventh-tenth aspect of the present invention.

In this figure, reference numeral 201 designates a vane drive motor. Reference numeral 202 designates a frame which is constituted by an upper plate 203 and a side plate 204 combined in an L character shape, which has the side plate 204 formed integrally with a bearing portion 205 in a projection manner, and which has the bearing portion 205 formed with a through hole 205*a*.

Reference numeral 206 designates screws for fixing the vane drive motor 201 to the frame 202. Reference numeral 207 designates an air outlet member which is fitted in the air outlet (not shown). Reference numeral 207*a* designates a through hole which is formed in a side surface of the air outlet member 207. Reference numeral 208 designates a vane which is housed in the air outlet member 207. Reference numeral 208*a* designates a shaft of the vane. The frame 202 is made of a material different from that of the vane 208. Reference numeral 209 designates a screw for fixing the frame 202 to the air outlet member 207. Although explanation of gear for the vane 208 is omitted, the sixth embodiment is applicable to not only a case where the vane drive motor 201 drives the vane 208 but also a case wherein the vane drive motor drives another vane (not shown) as well.

Now, assembly operation for this embodiment will be explained.

First, the vane drive motor 201 is assembled to the upper plate 203 of the frame 207, and the vane drive motor is fixed to the frame by the screws 206. Next, the frame 202 thus assembled is assembled to the air outlet member 207 by inserting the bearing portion 205 of the side plate 204 into the through hole 207*a* of the air outlet member 207. The side plate 204 is fixed to the air outlet member 207 by the screw 209. Finally, the shaft 208*a* of the vane is inserted into the through hole 205*a* of the bearing portion 205.

Since the through hole 205*a* of the bearing portion 205 works as a receiving portion for supporting the shaft 208*a* of the vane 208, and since the bearing portion 205 is integral with the frame 202, a bearing separate from the frame 2 is not necessary unlike prior art. As a result, the number of required parts and the number of required processes decrease, and required cost reduces. Because positioning of the frame 202 is carried out by inserting the bearing portion 205 into the through hole 207*a* of the air outlet member 207, the assembly can be made easily, and the number of required screws decreases. Since the frame 202 is made of a different material from the vane 208, the vane 208 can operates in a smooth manner.

Although fixing the vane drive motor 201 is made by the screws 206 and fixing the frame 202 is made by the screw 209 in this embodiment, the fixing of both parts is not limited to use of screws. Another fixing member may be used to make the fixing of both parts.

What is claimed is:

1. An air conditioner indoor unit comprising:

a housing;

an impeller arranged in the housing and forming a cross flow fan;

a rear side plate arranged downstream of the impeller and forming a rear side of a diffused air path;

a front side plate forming a front side of the diffused air path and including a first air outlet surface, a second air outlet surface and a third air outlet surface;

the first air outlet surface arranged near to the impeller and having a portion on a side of an air outlet of the diffused air path slanted in a direction away from a reference surface defined by a portion of the rear side plate near to, and upstream of, the air outlet;

the second air outlet surface arranged next to the first air outlet surface on the side of the air outlet and having a portion on the side of the air outlet slanted in a direction away from the reference surface; and the third air outlet surface arranged next to the second air outlet surface on the side of the air outlet end and having a portion on the side of the air outlet slanted at 20°–30° in the direction away from the reference surface.

2. An air conditioner indoor unit according to claim 1, wherein the first air outlet surface has the portion on the side of the air outlet slanted at 0°–5° in a direction away from the reference surface, the second air outlet surface has the portion on the side of the air outlet slanted at 7°–15° in the direction away from the reference surface, and the first, second and third air outlet surfaces have each of connected portions therebetween formed with a curved surface so as to provide a successively changed slant.

3. An air conditioner indoor unit according to claim 1, wherein a ratio of depth size of the first air outlet surface to height size of the diffused air path, a ratio of depth size of the second air outlet surface to the height size of the diffused air path and a ratio of depth size of the third air outlet surface to the height size of the diffused air path are respectively set to not less than 0.3.

4. An air conditioner indoor unit according to claim 1, wherein there are provided an edge portion forming an air outlet edge of the rear side plate and a deflecting member arranged on the rear side plate near to the air outlet and located nearer to the impeller than the edge portion, depth size of the deflecting portion in the air outlet along a diffusing direction is not greater than 0.3 times the height size of the diffused air path, and the deflecting portion has an upper surface with a leading portion and a base portion, the leading edge arranged to be slanted at 10°–25° in a direction away from the reference surface in comparison with the base portion so as to direct an air flow along the rear side plate in the diffused air path to a direction along a vane provided in the air outlet.

5. An air conditioner indoor unit according to claim 1, wherein a vane is arranged in the air outlet and is controllably pivoted therein through a horizontal axis, the vane is set at a first position to diffuse cool air generated by the cross flow fan in a horizontal or upward direction on start-up, the vane is displaced from the first position to a second position to diffuse the air more downwardly than the vane in the first position after elapse of a vapor condensation limit time for cool air supplied by the vane in the first position so as to eliminate vapor condensation on the vane, and the vane is returned to the first position after elimination of the vapor condensation, the vapor condensation limit time determined based on a diffused air temperature of the cool air, and a temperature and a humidity in a room with the indoor unit installed.

6. An air conditioner indoor unit according to claim 5, wherein the vane in the second position has a lower diffusing speed of the cool air than the vane in the first position.

7. An air conditioner indoor unit according to claim 1, wherein a vane is arranged in the air outlet and is controllable pivoted therein through a horizontal shaft, and a frame member for having a vane drive motor fixed thereto is provided with a receiving portion for supporting the shaft.

8. An air conditioner indoor unit according to claim 1, wherein a vane is arranged in the air outlet and is controllable pivoted therein through a horizontal shaft, and a frame member for having a vane drive motor fixed thereto is provided with a hole for supporting the shaft.

9. An air conditioner indoor unit according to claim 8, wherein the frame member is made of a material different from the shaft, and the frame member is integrally provided with a bearing portion having the hole for receiving the shaft.

10. An air conditioner indoor unit according to claim 9, wherein the air outlet is made of an air outlet member, the air outlet member is formed with a through hole, the bearing portion is formed to project from the frame member, and the bearing portion is inserted in the through hole in the air outlet member.

* * * * *